US007048091B1

(12) United States Patent
Maguire

(10) Patent No.: US 7,048,091 B1
(45) Date of Patent: May 23, 2006

(54) PORTABLE LIFEGUARD CHAIR

(75) Inventor: John P. Maguire, Missoula, MT (US)

(73) Assignee: Spectrum Products LLC, Missoula, MT (US)

( * ) Notice: Subject to any disclaimer, the term of this patent is extended or adjusted under 35 U.S.C. 154(b) by 126 days.

(21) Appl. No.: 10/778,489

(22) Filed: Feb. 13, 2004

(51) Int. Cl.
*A47C 13/00* (2006.01)
*E06C 7/16* (2006.01)

(52) U.S. Cl. ..... 182/33; 182/115

(58) Field of Classification Search ..... 182/115, 182/33, 33.3, 20, 116, 118, 17, 129; 248/519, 248/910; 114/162
See application file for complete search history.

(56) References Cited

U.S. PATENT DOCUMENTS

| | | | | | |
|---|---|---|---|---|---|
| 3,357,741 | A | * | 12/1967 | Samuel | 182/129 |
| 3,432,003 | A | * | 3/1969 | Pierre | 182/16 |
| 3,857,460 | A | * | 12/1974 | Nini | 182/17 |
| 4,258,952 | A | | 3/1981 | Dutra | 297/258 |
| 4,519,475 | A | * | 5/1985 | Bollinger | 182/17 |
| 5,082,086 | A | * | 1/1992 | Kerr | 182/17 |
| 5,572,921 | A | | 11/1996 | Krumbeck | 92/165 R |
| 5,781,939 | A | | 7/1998 | Bledsoe | 4/483 |
| 5,857,742 | A | | 1/1999 | Karl et al. | 297/248 |
| 5,887,944 | A | | 3/1999 | Boost | 297/258.1 |
| 6,036,563 | A | | 3/2000 | Walker | 441/130 |
| 6,170,612 | B1 | | 1/2001 | Krumbeck | 187/200 |
| 6,224,444 | B1 | | 5/2001 | Klimenko | 441/130 |
| 6,378,659 | B1 | | 4/2002 | Krumbeck | 187/200 |
| 6,637,549 | B1 | * | 10/2003 | Lopacki | 182/115 |
| 6,666,221 | B1 | | 12/2003 | Booth | 135/16 |
| 6,772,860 | B1 | * | 8/2004 | Nelson | 182/115 |

FOREIGN PATENT DOCUMENTS

GB 2051199 A * 1/1981

* cited by examiner

*Primary Examiner*—Hugh B. Thompson, II
(74) *Attorney, Agent, or Firm*—Shane P. Coleman; Holland & Hart LLP

(57) ABSTRACT

A portable chair is disclosed having a seat, a frame that supports the seat, a ladder that provides access to the seat; and a hollow tank that holds a liquid mass, connected to the frame. The frame includes first and second side supports each having a forward support and a rear support. Each of the forward and rear supports has an upper end and a lower end, and the seat is connected to the frame proximate the upper ends of the forward and rear supports. The frame also includes a lower frame that connects the forward supports to the rear supports near the lower ends of the forward and rear supports. The tank is connected to the lower frame to provide stability to the chair.

27 Claims, 7 Drawing Sheets

PORTABLE LIFEGUARD CHAIR

FIELD OF INVENTION

The present invention relates generally to a chair for use by a lifeguard at a swimming pool or beach. More particularly, it relates to a portable chair having a ballast connected to a lower portion of the chair to maintain the chair in an upright position.

BACKGROUND

Lifeguard chairs are used by pool and beaches to allow a lifeguard to sit and observe individuals swimming or recreating near the water. Generally, a lifeguard chair includes a raised platform with a seat attached thereto. The seat allows the user to be positioned approximately 4 to 10 feet above the ground. A ladder may be used as part of the chair to allow the lifeguard to access the seat.

In some uses, the lifeguard chair is permanently affixed to the ground. For smaller pools and other environments, however, the lifeguard chair is portable. A frame of the lifeguard chair supports the chair and generally has a sufficiently wide base to provide support on the pool deck or other surface.

A problem with portable lifeguard chairs is that they can tip over in high winds. A falling chair can be dangerous for a lifeguard using the chair or for individuals around the chair if no lifeguard is in the chair when the chair falls over. Also, the chair may be damaged if tips over in the wind. What is needed is a improved lifeguard chair.

SUMMARY

A portable chair is disclosed having a seat, a frame that supports the seat, a ladder that provides access to the seat; and a hollow tank that holds a liquid mass, connected to the frame. The frame includes first and second side supports each having a forward support and a rear support. Each of the forward and rear supports has an upper end and a lower end, and the seat is connected to the frame proximate the upper ends of the forward and rear supports. The frame also includes a lower frame that connects the forward supports to the rear supports near the lower ends of the forward and rear supports. The tank is connected to the lower frame to provide stability to the chair.

An adjustable ballast for attachment to a chair is also disclosed. The ballast includes a tank having a top portion, a bottom portion, and sides that connect the top and bottom portions. The tank has first and second holes defined therein. The first hole is defined proximate the top portion of the tank and receives a fluid mass. The second hole is defined proximate the bottom portion and is used to drain the fluid mass from the tank. The ballast further includes first and second support members connected to the bottom portion of the tank. The support members have first and second ends that extend beyond the sides of the tank. Each end has a connector adapted to connect to a lower portion of a frame of a chair.

A chair is also disclosed having a frame and a ballast. The frame includes first and second forward and rear supports. The ballast is connected to a lower portion of the frame. The ballast includes a tank that holds 15–25 gallons of a liquid and a ballast support member that is fixedly connected to a bottom portion of the tank and detachably connected to the lower portion of the frame.

SUMMARY OF DRAWINGS

The detailed description will refer to the following drawings, wherein like numerals refer to like elements, and wherein.

DETAILED DESCRIPTION

Figure 1:
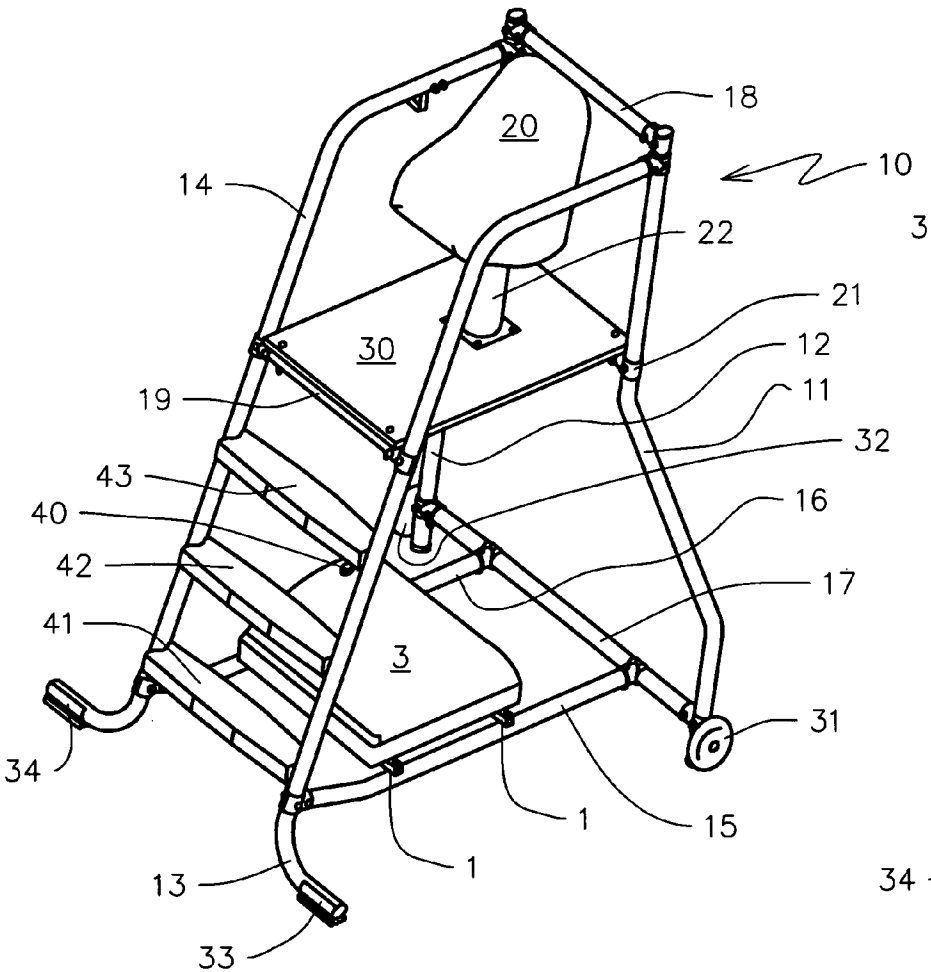
FIG. 1 shows a perspective view of a chair having a seat connected to a raised platform.

FIG. 1 shows a chair 10 having a seat 20 connected to a platform 30 by a post 22. The platform 30 is substantially horizontal when the chair 10 is in use, in its upright position. The platform 30 is raised and is supported by a frame. Other embodiments do not include a platform 30. In the example of FIG. 1 the frame includes first and second sides. Each of the sides comprises a front member 13, 14 connected to rear member 11, 12. Cross-members 17, 18, 19, 21 connect the first and second sides of the frame. Specifically, the uppermost cross-member 18 connects the first and second rear support members 11, 12 near an upper end of the frame, that is, near the upper ends of the first and second rear members 11, 12. Two cross-members 19, 21 support the platform 30. Cross-member 19 connects the first and second forward supports 13, 14. Cross-member 21 connects the first and second rear supports 11, 12. A lower cross-member 17 also connects the first and second rear supports 11, 12.

In the example of FIG. 1, the chair 10 includes wheels 31, 32 connected to lower ends of the rear supports 11, 12. In the example of FIG. 1, the rear supports 11, 12 extend below the wheels 31, 32 when the chair 10 is in an upright position as shown in FIG. 1, but the wheels 31, 32 contact the ground when the top of the chair 10 is tipped backward. This allows the user of the chair 10 to tip the chair 10 backward and wheel the chair 10 around for easy transportation. However, when the chair 10 is upright, the wheels 31, 32 do not contact the ground so that the chair 10 does not move while in use.

The first and second forward supports 13, 14 are also connected to each other by steps 41, 42, 43 that form a ladder and provide access to the platform 30. Other embodiments may include more steps or fewer steps, or no steps at all. In the example of FIG. 1, the forward supports 13, 14 may be used as handrails of the ladder. Lower portions of the forward member 13, 14 bend to an L-shape, extending outward from the chair 10 to provide a wider base for the chair 10. Pads 33, 34 formed, for example, from non-slip rubber or plastic, are connected near ends of the first and second forward supports 13, 14 and are used to hold the chair 10 in place and to keep it from slipping in use.

A ballast keeps the chair 10 steady and upright under windy conditions. In the example of FIG. 1, the ballast is a hallow tank 3 adapted to hold water or a similar liquid mass. In one example, the tank 3 is formed from an impervious plastic that is adapted to contain the liquid mass. Ballast supports 1 connect to the lower portion of the tank 3 and detachably connect to lower frame members 15, 16 that connect the forward supports 13, 14 to the lower rear cross-member 17. The tank 3 includes an inlet hole 40 for the addition of water to the tank 3. In one embodiment, the tank 3 also includes a drain sprout (not shown) that allows draining of the tank 3.

In use, the chair 10 with an empty tank 3 is moved to an upright position. The tank 3 is then filled with water using the hole 40. In one embodiment, the tank 3 is 15–25 gallons in size. In one example, the tank 3 is approximately 18 gallons in size. This size of a tank 3 creates a ballast weight of approximately 155 pounds when the tank 3 is filled with water. The water weight of the ballast 3 keeps the chair 10 steady and upright under windy conditions. When the user wants to then move the chair 10, the water or other fluid is drained from the tank 3 and the lightened chair 10 may then be moved.

Figure 2:
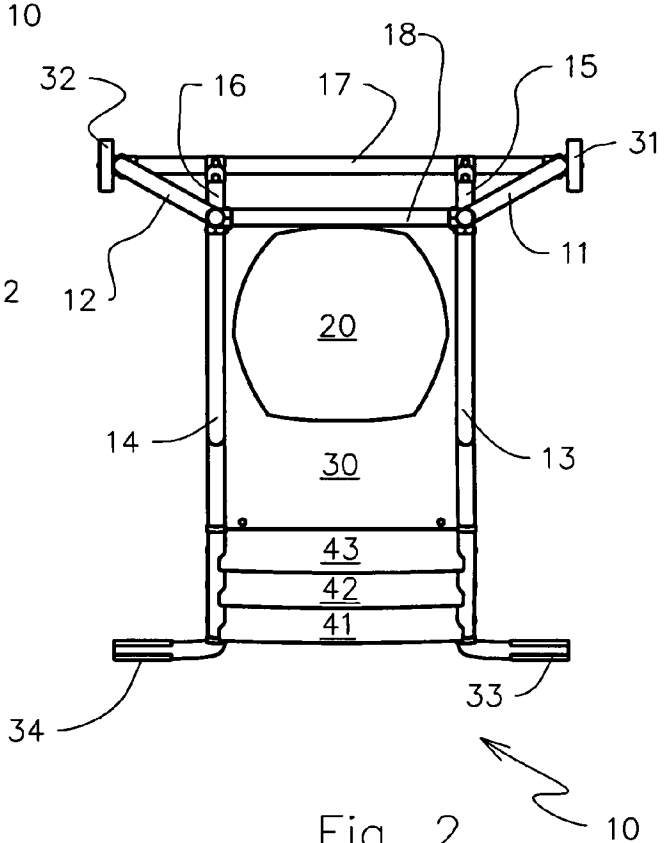
FIG. 2 shows a top view of the chair shown in FIG. 1.

FIG. 2 shows a top view of the chair 10. As shown in FIG. 2, the platform 30 is substantially horizontal relative to the surface on which the chair 10 rests. Steps 41, 42, 43 provide access to the platform 30 so that a user can sit in the seat 20. Other embodiments of the chair 10 do not include a platform 30.

Figure 3:
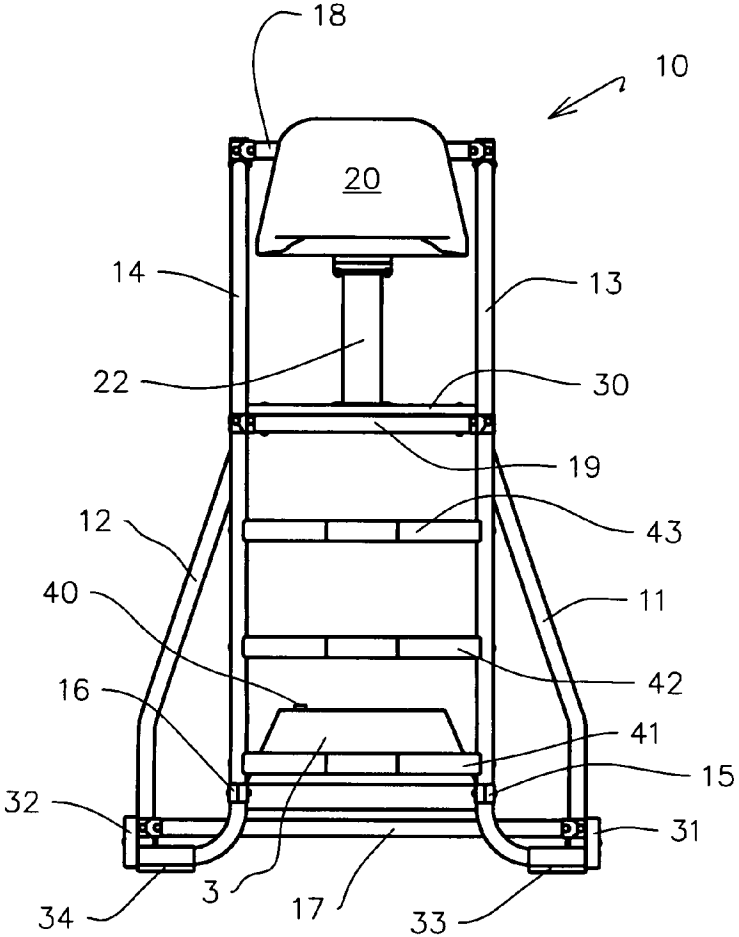
FIG. 3 shows a front view of the chair shown in FIG. 1.

FIG. 3 shows a front view of the chair 10. As shown in FIG. 3, the platform 30 is connected to the cross-member 19. Rear cross-member (21 in FIG. 1) also supports a rear portion of the platform 30. As also shown in FIG. 3, the rear supports 11, 12 deflect outwardly from the center of the chair 10 to provide for a wider base of the chair 10. The tank 3 connects to the chair 10 near the lower portion of the frame. In this example, the tank 3 connects to lower frame members 15, 16 using ballast support members (not shown). The lower frame members 15, 16 connect to lower ends of the forward and rear supports 11, 12, 13, 14.

Figure 4:
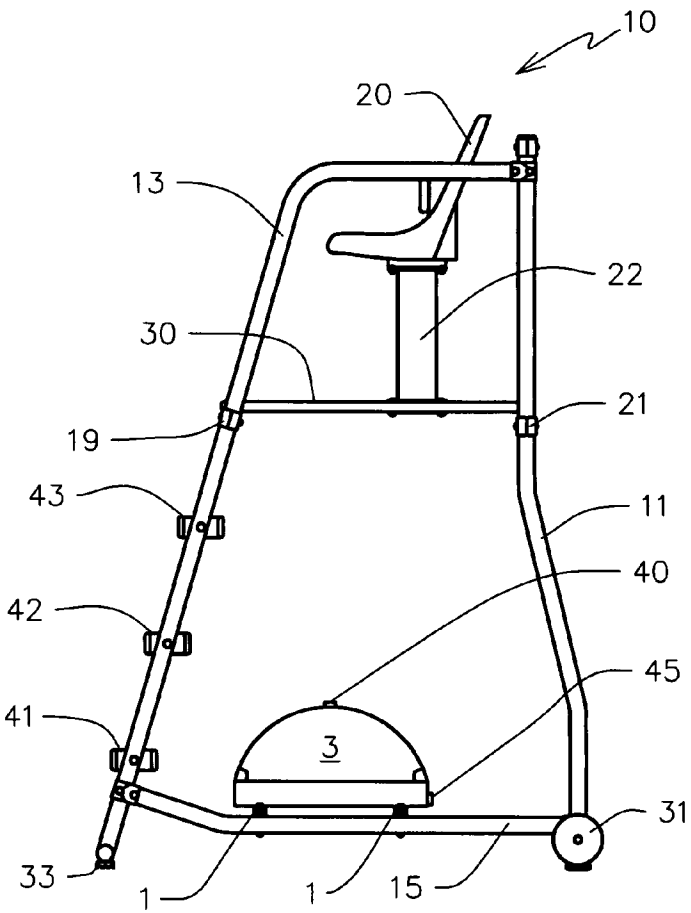
FIG. 4 shows a side view of the chair shown in FIG. 1.

FIG. 4 shows a side view of the chair 10. As shown FIG. 4, the platform 30 is supported by first and second cross-members 19, 21. As also shown in FIG. 4, the tank 3 is connected to the frame of the chair 10 near a lower portion of the frame by two ballast support members 1. In the example of FIG. 4, the tank 3 includes an inlet hole 40 for receiving a liquid, such as water. The tank 3 also includes a drain sprout 45 that is positioned at or near the bottom of the tank 3. In the example of FIG. 4, the drain sprout 45 is positioned in one of the sides of the tank 3, near the bottom of the tank 3. The position of the drain sprout 45 allows water to be drained from the tank 3 by releasing a plug (not shown) that may be inserted in the drain sprout 45 to retain the water. Also, by positioning the drain sprout 45 in the sidewall of the tank 3 facing the rear of the chair 10, as shown in FIG. 4, the last of the water in tank 3 may be drained by tipping the chair 10 backward on its wheels 31, 32. In other embodiments, a granular mass, such as sand, may be used to fill the tank 3 to provide a ballast.

Figure 5:
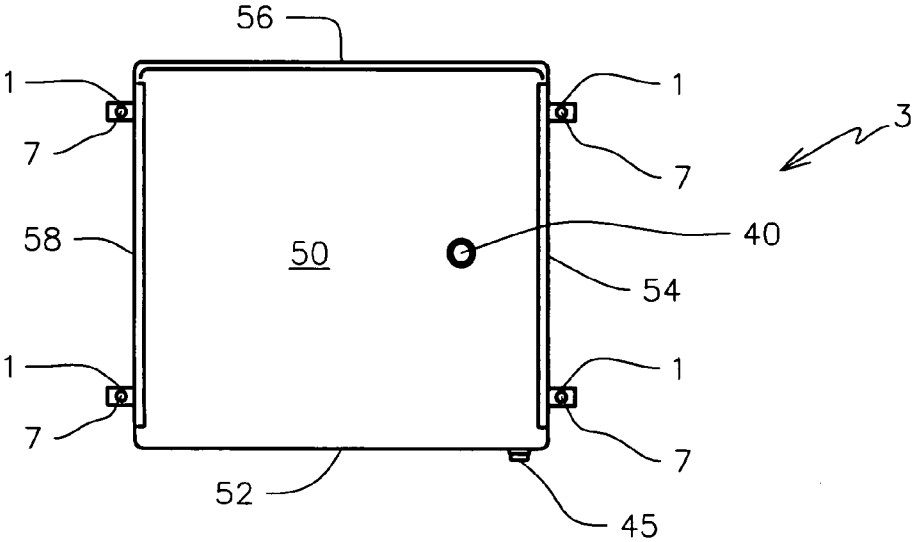
FIG. 5 shows a top view of the tank.

FIG. 5 shows a top view of the tank 3. In the example of FIG. 5, the tank 3 is substantially square having four sides 52, 54, 56, 58. In one embodiment, the tank 3 is approximately 6–18 inches high and 12–24 inches square. The tank 3 also includes a top portion 50. An inlet hole 40 is used to receive water in the tank 3. Water in the tank 3 may be drained from the tank 3 using the drain sprout 45. Ballast support members 1 connect to the bottom of the tank 3. The ballast support members 1 are adapted to connect to a frame of a lifeguard chair (e.g., 10 in FIG. 1) for example using bolts 7.

Figure 6:
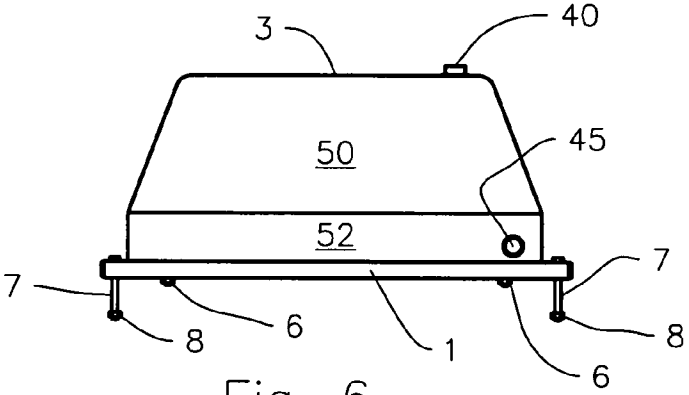
FIG. 6 shows a side view of the tank shown in FIG. 5.

FIG. 6 shows a side view of the tank 3 shown in FIG. 5. As shown in FIG. 6 the ballast support members 1 connect to the bottom of the tank 3 using bolts 6. In the example of FIG. 6, the tank 3 is fixedly connected to the ballast support members 1, but is detachably connected to a chair (e.g., 10 in FIG. 1). In this manner, the tank 3 may be removed from the lifeguard chair 10 as needed.

Figure 7:
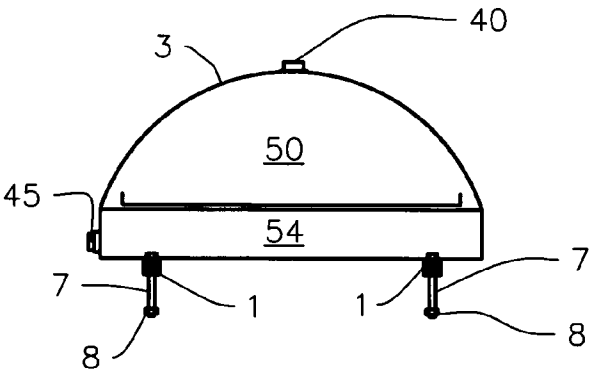
FIG. 7 shows another side view of the tank shown in FIGS. 5 and 6.

FIG. 7 shows another side view of the tank 3 shown in FIGS. 5 and 6. As shown in FIG. 7, in this example the ballast support members 1 are hollow steel tubes having substantially square cross-sections. Using bolts 7 and nuts 8 the ballast support members 1 connect to a lower portion of the frame of a lifeguard chair 10.

Figure 8:
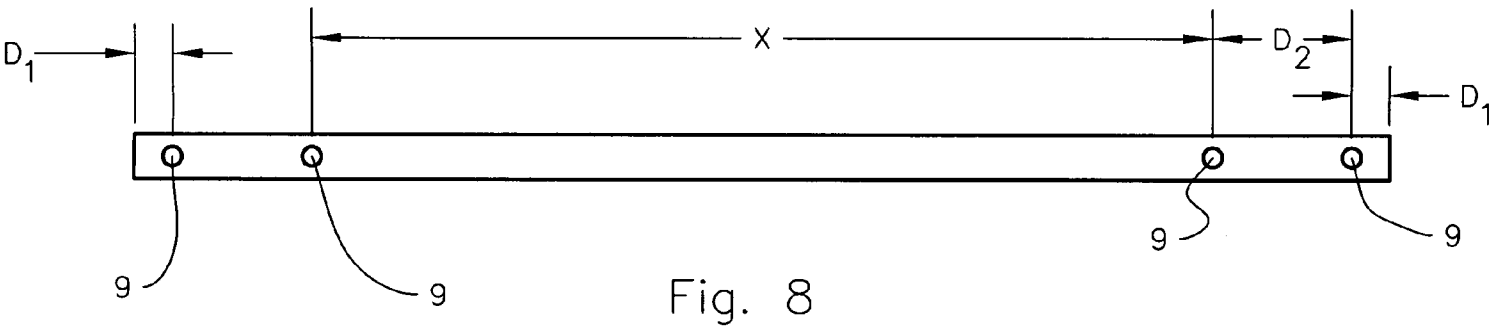
FIG. 8 shows a top view of one of the ballast support member.

FIG. 8 shows a top view of one of the ballast support members 1. In the example of FIG. 8, the ballast support member 1 has four holes defined therein. The inner holes 9 are spaced apart from each other by a distance X. In one embodiment, the distance X is in the range of 1–2 feet. These holes receive bolts (not shown) that connect the bottom of the tank 3 to the ballast support member 1. Outer holes 9 are spaced from the ends of the ballast support members 1 by a distance of $D_1$ and are spaced from the inner holes by distance of $D_2$. In one embodiment, the distance $D_1$ is in the range of 0.5–1.5 inches and $D_2$ is in the range of 3–6 inches. The outer holes 9 receive bolts (not shown) that connect the ballast support member 1 to the lower portion of the frame of the chair 10. In another embodiment (not shown) the ballast support members 1 may have multiple holes positioned between the tank 3 and the ends of the ballast support members 1 to accommodate chairs of different sizes and/or the holes 9 may be oval-shaped to provide greater adjustment of the connection between the ballast support members 1 and the frame of the chair 10.

Figure 9:
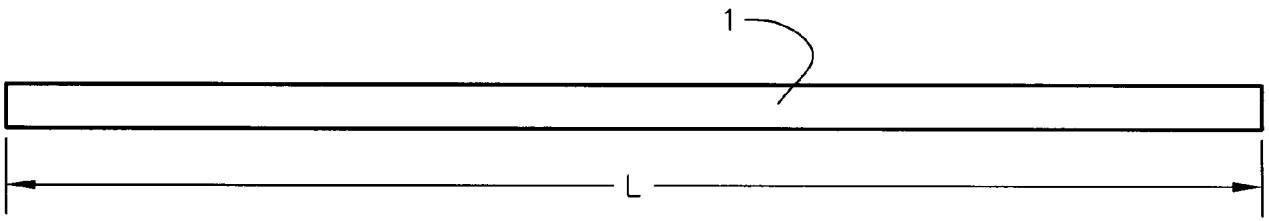
FIG. 9 shows a side view of the ballast support member.

FIG. 9 shows a side view of the ballast support member 1. As shown in FIG. 9, the ballast support member 1 has a substantially square cross-section and has a length L. In one embodiment, the length L is in the range of 1.5–3.0 feet. In another embodiment, the ballast support member 1 has an adjustable length L, for example, using a telescoping extension. In this example, the ballast support member 1 is adapted to connect to different chairs (e.g., 10 in FIG. 1) having lower frame members spaced at different distances.

Figure 10:
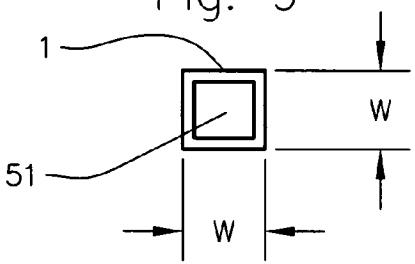
FIG. 10 shows a cross-section of the ballast support member shown in FIGS. 8 and 9.

FIG. 10 shows a cross-section of the ballast support member 1 shown in FIGS. 8 and 9. In this example, the ballast support member 1 is a hollow steel tube having an interior cavity 51 and a substantially square cross-section. The sides of the steel tube have widths W. In one embodiment, the width W is in the range of 0.5–2.0 inches.

Figure 11:
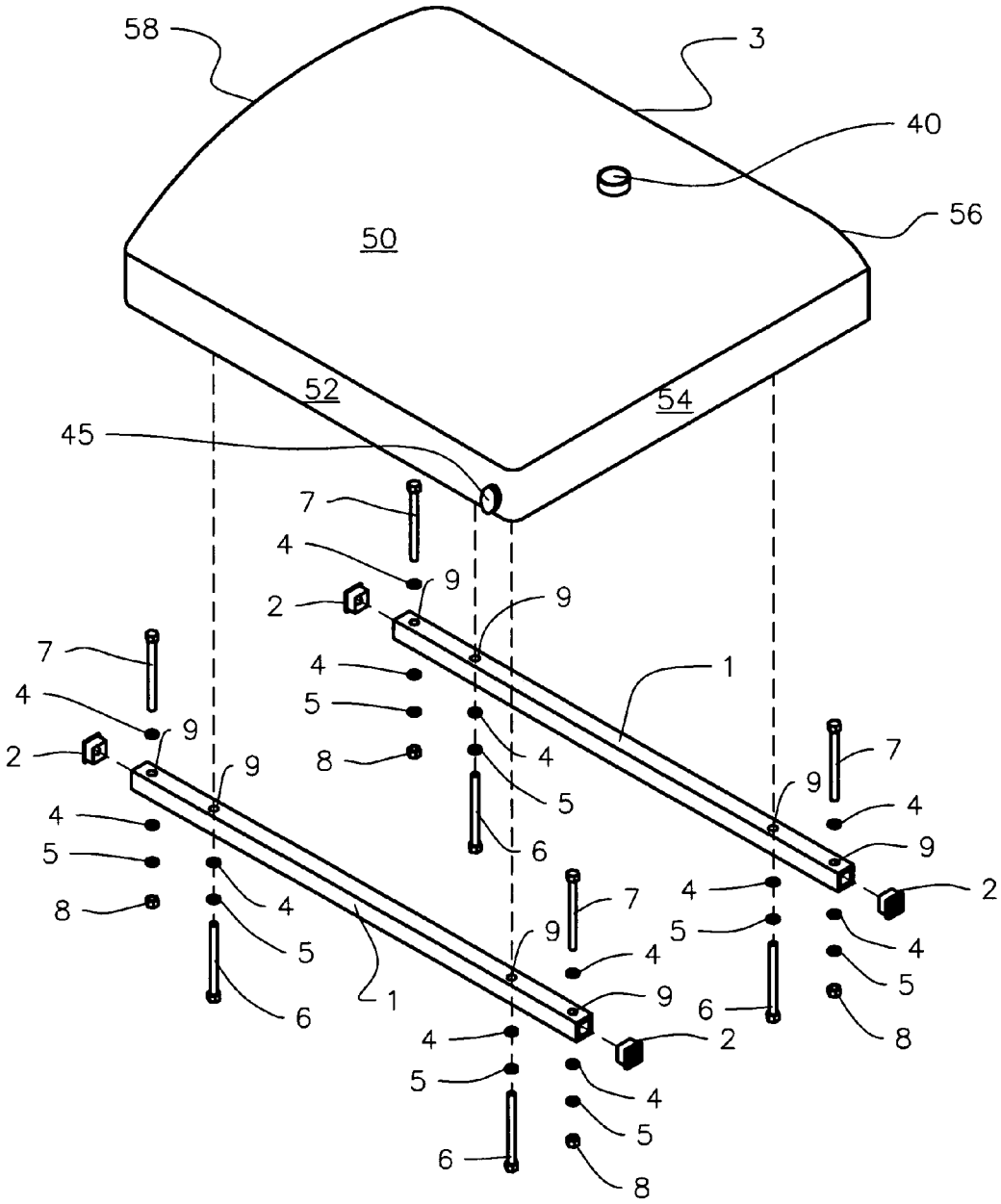
FIG. 11 shows an assembly view of the ballast and the ballast support members.

FIG. 11 shows an assembly view of the tank 3 and the ballast support members 1. The tank 3 includes a top surface 50 and sides 52, 54, 56, 58. The tank 3 also includes and inlet hole 40 and a drain sprout 45. In one embodiment, the tank 3 is formed from a lightweight plastic material. Two substantially parallel ballast supports 1 connect to a lower portion of tank 3. The tank 3 is connected to the ballast supports 1 by a bolt 6, a lock washer 5, and a flat washer 4. The bolts 6 pass through holes 9 defined in the ballast support member 1. The ballast support member 1 connects to a lower portion of a frame of a chair (e.g., 10 in FIG. 1) using bolts 7 that pass through holes 9, and uses flat washer 4 and lock washer 5 to engage a nut 8. In the example of FIG. 11, the ballast support members 1 are hollow steel tubes having substantially square cross-section. End caps are used to cover ends of the ballast support members 1.

Figure 12:
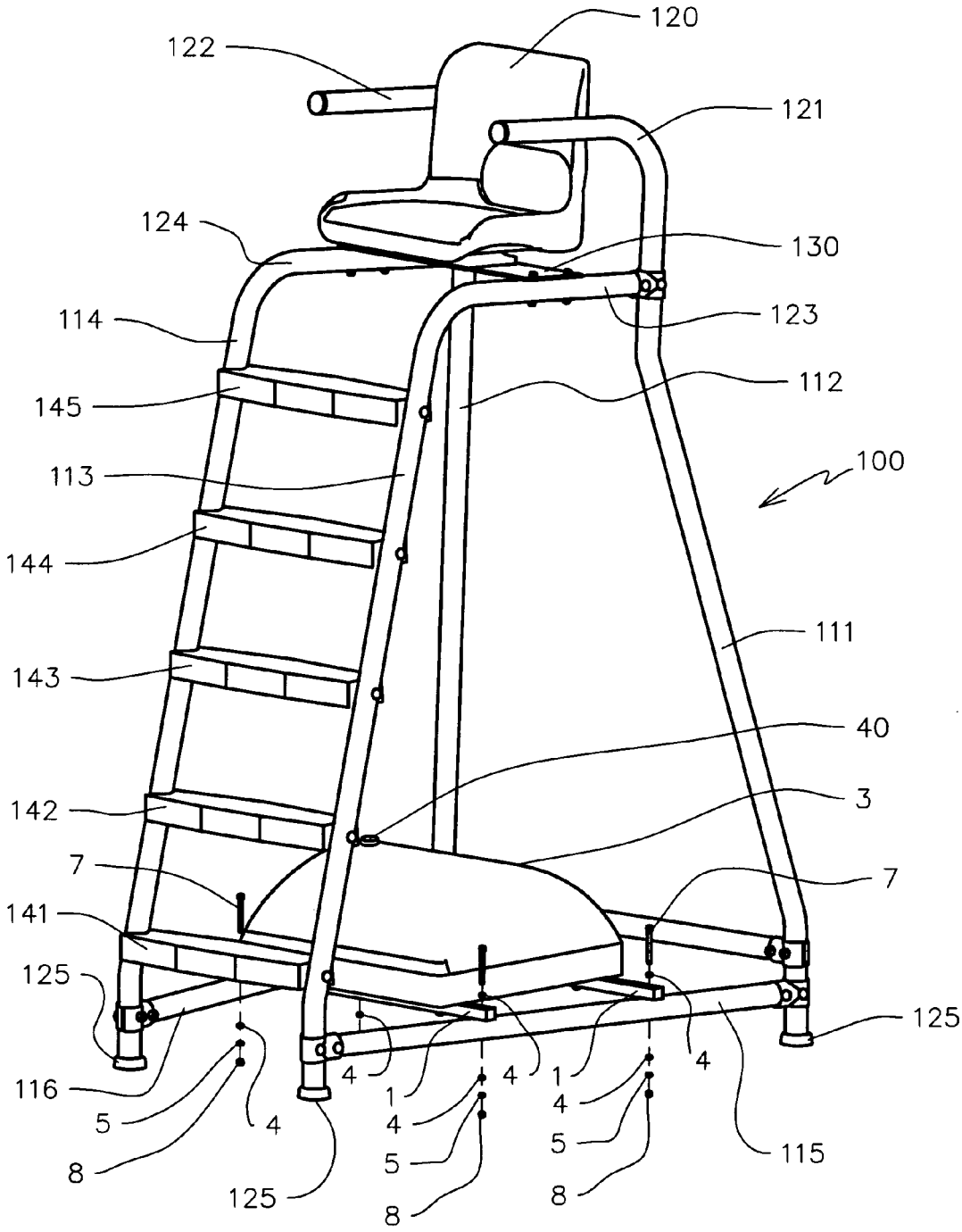
FIG. 12 shows a perspective view of another embodiment of a chair.
Figure 13:
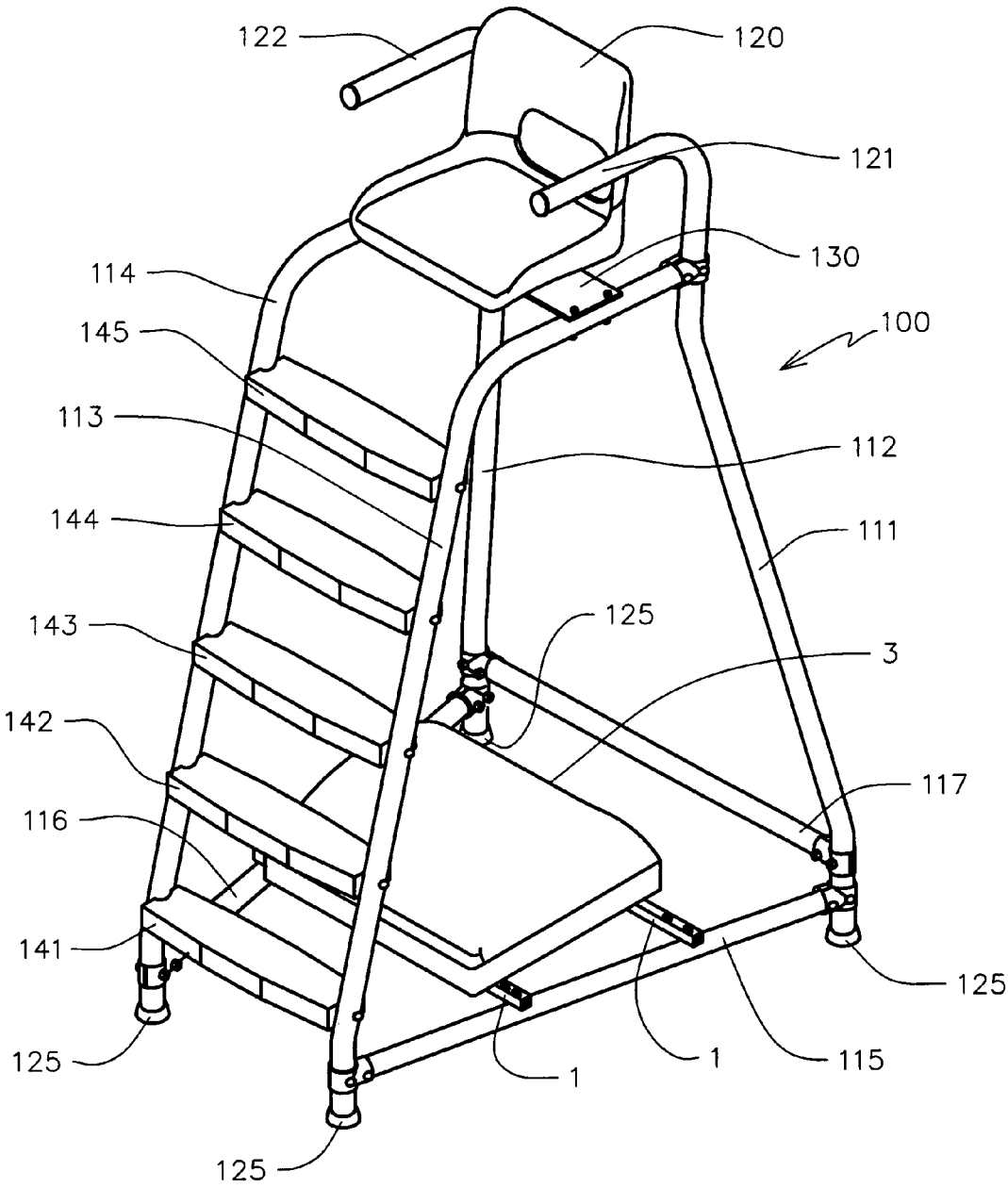
FIG. 13 another perspective view of the chair shown in FIG. 12.

FIGS. 12 and 13 show perspective views of another embodiment of a chair 100 having a tank 3, in which the chair 100 has five steps 141, 142, 143, 144, 145 and no platform (e.g., 30 in FIG. 1). The chair 100 has first and second sides, each side comprising a forward support 113, 114 and a rear support 111, 112. The forward supports 113, 114 connect to each other by the steps 141, 142, 143, 144, 145 and by a base plate 130 that supports a seat 120. Upper ends of the rear supports 111, 112 form arm rests 121, 122 adjacent the seat 120. Upper ends of the forward supports 113, 114 form generally horizontal supports 123, 124 for the base plate 130 that holds the seat 120. Lower ends of the front and rear members 111, 112, 113, 114 have feet 125, such as rubber or plastic caps, that contact the ground surface.

First and second lower frame members 115, 116 connect first and second forward supports 113, 114 to first and second rear supports 111, 112, respectively. Ballast supports 1 connect to the first and second lower frame members 115, 116 and support the tank 3. In the example of FIG. 12, the ballast supports 1 are connected to the lower frame supports 115, 116 using screws 7, nuts 8, and washers 4, 5. In other embodiments, different attachments may be used. One embodiment (not shown) allows the tank 3 to releasably attach and detach from the frame of the chair 100 quickly and easily, for example, using clamps.

Although the present invention has been described with respect to particular embodiments thereof, variations are possible. The present invention may be embodied in specific forms without departing from the essential spirit or attributes thereof. It is desired that the embodiments described herein be considered in all respects illustrative and not restrictive and that reference be made to the appended claims and their equivalents for determining the scope of the invention.

What is claimed is:

1. A portable chair comprising:

a seat;

a frame that supports the seat, wherein the frame comprises first and second side supports each having a forward support and a rear support, wherein each of the forward and rear supports has an upper end and a lower end, wherein the seat is connected to the frame proximate the upper ends of the forward and rear supports; and a lower frame that connects the forward supports to the rear supports near the lower ends of the forward and rear supports;

a ladder formed between the forward supports of the frame, wherein the ladder comprises one or more steps that provide access to the seat;

a hollow tank connected to the lower frame, wherein the hollow tank has an opening defined therein for receiving a mass; and one or more ballast support members that detachably connect the tank to the lower frame, wherein the one or more ballast support members have adjustable lengths.

2. The chair of claim 1, wherein the hollow tank is adapted to receive a liquid mass and defines first and second openings, wherein the first opening is positioned proximate a top portion of the tank and receives the liquid mass to fill the tank, and wherein the second opening is proximate a bottom portion of the tank, and is used to drain the liquid mass from the tank.

3. The chair of claim 2, wherein the second opening is defined in a rear side of the tank and allows the liquid mass to drain when a top portion of the chair is tipped backward, toward the rear supports.

4. The chair of claim 2, wherein the second opening faces a side of the chair, and further comprising a wheel connected to the frame at the side of the chair.

5. The chair of claim 4, wherein the wheel allows rotational movement of the chair toward and away from the side, to thereby drain the liquid mass from the tank through the second opening.

6. The chair of claim 1, further comprising wheels connected to the frame proximate the lower ends of the rear supports.

7. The chair of claim 6, wherein the wheels are connected to the frame at a point such that the wheels are positioned above a ground surface when the chair is in an upright position and such that the wheels contact the ground surface when the top of the chair is pivoted backward relative to the ground surface.

8. The chair of claim 1, wherein the tank has a volume of 15–20 gallons.

9. The chair of claim 8, wherein the tank is formed from a plastic and has a height in the range of 6–12 inches and a base that is substantially square with sides having lengths in the range of 12–24 inches.

10. The chair of claim 1, further comprising a platform connected proximate the upper ends of the forward and rear supports, wherein the platform supports a seat, and wherein the ladder provides access to the platform.

11. A portable chair comprising:

a seat, a frame that supports the seat, wherein the frame comprises first and second side supports each having a forward support and a rear support, wherein each of the forward and rear supports has an upper end and a lower end, wherein the seat is connected to the frame proximate the upper ends of the forward and rear supports; and a lower frame that connects the forward supports to the rear supports near the lower ends of the forward and rear supports;

a ladder formed between the forward supports of the frame, wherein the ladder comprises one or more steps that provide access to the seat;

a hollow tank connected to the lower frame, wherein the hollow tank has an opening defined therein for receiving a mass; and one or more ballast support members, wherein the one or more ballast support members are elongated members having opposing ends, wherein the tank is connected to the ballast support members between the ends, and wherein the ballast support members connect to lower frame at points between the tank and the ends.

12. The chair of claim 11, wherein each of the ballast support members has a plurality of holes defined therein between the tank and the ends for connection to the frame.

13. The chair of claim 11, further comprising a platform connected proximate the upper ends of the forward and rear supports, wherein the platform supports a seat, and wherein the ladder provides access to the platform.

14. The chair of claim 11, wherein the one or more ballast support members have adjustable lengths.

15. A portable chair comprising:

a seat:

a frame that supports the seat, wherein the frame comprises first and second side supports each having a forward support and a rear support, wherein each of the forward and rear supports has an upper end and a lower end, wherein the seat is connected to the frame proximate the upper ends of the forward and rear supports; and a lower frame that connects the forward supports to the rear supports near the lower ends of the forward and rear supports;

a platform connected proximate the upper ends of the forward and rear supports, wherein the platform supports the seat;

a ladder formed between the forward supports of the frame, wherein the ladder provides access to the platform;

a hollow tank connected to the lower frame, wherein the hollow tank has an opening defined therein for receiving a mass.

16. The chair of claim 15, wherein the hollow tank is adapted to receive a liquid mass and defines first and second openings, wherein the first opening is positioned proximate a top portion of the tank and receives the liquid mass to fill the tank, and wherein the second opening is proximate a bottom portion of the tank, and is used to drain the liquid mass from the tank.

17. The chair of claim 16, wherein the second opening is defined in a rear side of the tank and allows the liquid mass to drain when a top portion of the chair is tipped backward, toward the rear supports.

18. The chair of claim 15, further comprising wheels connected to the frame proximate the lower ends of the rear supports.

19. The chair of claim 18, wherein the wheels are connected to the frame at a point such that the wheels are positioned above a ground surface when the chair is in an upright position and such that the wheels contact the ground surface when the top of the chair is pivoted backward relative to the ground surface.

20. A chair comprising:

a frame having first and second forward and rear supports; and a ballast connected to a lower portion of the frame, wherein the ballast comprises a tank that holds 15–25 gallons of a liquid, and a rigid, elongated ballast support member that is positioned generally beneath the tank and is fixedly connected to a bottom portion of the tank and detachably connected to the lower portion of the frame.

21. The chair of claim 20, further comprising wheels connected proximate lower ends of the rear support members of the frame, such that the lower ends of the frame extend beyond the wheels and, when the chair is in an upright position on a ground surface, position the wheels above the ground surface such that the wheels do not cause the chair to move and, when a top portion of the chair is tilted backward toward the rear supports, cause the wheels to contact the ground surface to enable the chair to be moved using the wheels.

22. The chair of claim 21, wherein the tank comprises a drain spout positioned proximate a rear side of the tank that faces the rear supports, wherein the drain spout permits draining of the liquid from the tank when the chair is tilted backward toward the rear supports.

23. The chair of claim 19, further comprising a seat connected to the frame.

24. The chair of claim 20, wherein the frame further comprises first and second lower frame members, and wherein the ballast support member has first and second ends that connect, respectively, to the first and second lower frame members.

25. A chair comprising:

a frame comprising first and second forward and rear supports, and first and second lower frame members, wherein the first lower frame member connects the first forward support to the first rear support and wherein the second lower frame member connects the first forward support to the second rear support; and a ballast connected to a lower portion of the frame, wherein the ballast comprises a tank that holds a liquid, and a ballast support member that is fixedly connected to a bottom portion of the tank and detachably connected to the lower portion of the frame, wherein the ballast support member has first and second ends, wherein the first end connects to the first lower support and the second end connects to the second lower support.

26. The chair of claim 25, wherein the first and second lower frame members are positioned substantially horizontal when the chair is in use on a ground surface, and wherein the first and second lower frame members are spaced from the ground surface by a distance in the range of 4 inches to 16 inches.

27. The chair of claim 26, wherein the first and second forward supports have lower ends that form L-shapes, extending outward from the frame of the chair.

* * * * *